US007048610B1

(12) United States Patent
Tregub et al.

(10) Patent No.: US 7,048,610 B1
(45) Date of Patent: May 23, 2006

(54) CONDITIONING POLISHING PAD FOR CHEMICAL-MECHANICAL POLISHING

(75) Inventors: Alexander Tregub, San Jose, CA (US); Mansour Moinpour, San Jose, CA (US); Victor K. Souw, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 11/044,125

(22) Filed: Jan. 26, 2005

(51) Int. Cl.
*B24B 1/00* (2006.01)

(52) U.S. Cl. ..... 451/7; 451/5; 451/285; 451/41; 323/280

(58) Field of Classification Search ..... 451/5, 451/7, 285, 41; 323/280
See application file for complete search history.

(56) References Cited

U.S. PATENT DOCUMENTS

| | | | | |
|---|---|---|---|---|
| 5,225,766 | A | 7/1993 | O'Neill | |
| 2002/0052174 | A1* | 5/2002 | Nishimura et al. | 451/54 |
| 2003/0104769 | A1* | 6/2003 | Brunelli | 451/53 |
| 2005/0003738 | A1* | 1/2005 | He | 451/5 |
| 2005/0101228 | A1* | 5/2005 | Prasad | 451/41 |
| 2005/0148185 | A1* | 7/2005 | Hirabayashi et al. | 438/692 |
| 2005/0170760 | A1* | 8/2005 | Homma et al. | 451/41 |

* cited by examiner

*Primary Examiner*—Lee D. Wilson
*Assistant Examiner*—Anthony Ojini
(74) *Attorney, Agent, or Firm*—Schwabe, Williamson & Wyatt, P.C.

(57) ABSTRACT

In one embodiment, a CMP pad is conditioned by repeatedly cycling the CMP pad between a first temperature and a second temperature higher than the first temperature to eliminate at least one crystalline area in the CMP pad.

30 Claims, 9 Drawing Sheets

CONDITIONING POLISHING PAD FOR CHEMICAL-MECHANICAL POLISHING

BACKGROUND

1. Technical Field

Embodiments of the present invention are related to the field of chemical-mechanical polishing, and in particular, to conditioning pads for chemical-mechanical polishing.

2. Description of Related Art

Chemical-mechanical polishing ("CMP") is a commonly used technique for planarizing a film on a semiconductor wafer prior to processing of the wafer. CMP often requires an introduction of a polishing slurry onto a surface of the film as the wafer is being mechanically polished against a rotating polishing pad.

Use of the polishing pads, as received from the suppliers, may result in significant variations in removal rates during planarization of the wafers. Pad "break-in" is used to recondition the surface of the pad prior to use in the manufacturing process for semiconductor wafers. For example, in some cases, the break-in procedure may remove a top impervious, hydrophobic layer. The break-in procedure consists of polishing of the dummy wafers using new pads. The exact number of the wafers to be polished to achieve the desired initiation is determined empirically, and is used indiscriminately for different pad types and lots. In general, the number of wafers used should depend on the pad type, CMP process conditions, and a layer on the dummy wafers used for break-in. In one illustrative CMP process, the pad is heated to as high as 100° C. due to mechanical friction between pad and wafer. A typical break-in process consists of the series of approximately 5 minutes long wafer polishes of up to 30 wafers.

It has been discovered that an un-intentional benefit of the thermal cycles of the extended pad break-in procedure is to normalize or initiate the pad properties. Hence, it is empirically known that pad break-in may help to stabilize pad CMP performance, which is determined by the pad properties. However, in this prior art break-in procedure, there is no accurate way to control change of the pad properties caused by the thermal cycling of the break-in process. Since the current state of art is based on empirical knowledge; break-in conditions are not be optimized for specific pads or CMP processes.

Pads may be made of polyurethane and, when received from suppliers, may have crystalline phases of polyurethane. These crystalline phases—which are randomly distributed within the pad as well as within a given pad lot or pad batch—may have an uncontrolled and unpredictable impact on pad performance and may affect pad stability. Hence, the existence of thermally unstable crystalline areas in the new, as received pad, makes a typical polyurethane pad unstable. It is known that when a new, as received, pad is exposed to a single heating ramp reaching a temperature of 200° C. or above, there is a disappearance of exothermic peaks that relate to the break up of the crystalline phase of the polyurethane.

Additionally, processing temperatures for polymer-based CMP pads, during the manufacturing process for the pads, is one of the major contributors to the pad life. Temperature treatment causes irreversible changes in thermoset polymers, such as polyurethane-based pads. Polymer hardness frequently changes in a broad temperature range so that small deviations in temperature may result in a large change of polymer hardness. Establishing accurate criteria for selection of a desired processing temperature is a challenge; pad processing at non-desired temperatures may affect pad CMP performance. It is desirable to conduct processing at the lowest possible temperatures. However, some desirable properties during processing may be only achieved at the elevated temperatures. For example, during one stage of the manufacturing process, softening of the pad allows for pad patterning.

DETAILED DESCRIPTION OF ILLUSTRATIVE EMBODIMENTS

In the following description, for purposes of explanation, numerous details are set forth in order to provide a thorough understanding of the disclosed embodiments of the present invention. However, it will be apparent to one skilled in the art that these specific details are not required in order to practice the disclosed embodiments of the present invention.

With respect to the prior art described above, in the prior art break-in procedure, there is no accurate way to control change of the pad properties. Hence, a controlled thermal cycling (thermocycling) process, according to one method of the present invention, is directed toward achieving control of and improved uniformity of the pad properties. This controlled thermal cycling may be introduced prior to the traditional pad initialization or break-in of a new, as received pad.

Additionally, the break-in procedure of the prior art is an expensive and non-controlled process. Hence, the controlled thermal cycling, according to one method of the present invention, may shorten the traditional pad break-in process and may provide cost savings based upon the reduction of the break-in process. Cost saving of this shortened break-in process may include cost of the CMP consumables, CMP operating tool time, and the wafers used for break-in.

In general, the thermal cycling, according to one method of the present invention, may be applied in an inert atmosphere to the new, as received pad, before use in the CMP processes. This thermal cycling of the pad is conducted in controlled conditions; it does not depend on layer in the dummy wafer, which is being polished-out, and conditions of break-in process. Moreover, for each pad type, the desired cycling conditions may be custom selected. As such, CMP process variations within the pad lots, and from pad to pad, may be reduced. This in turn may lead to a more stable polish process and/or longer pad life.

Figure 1:
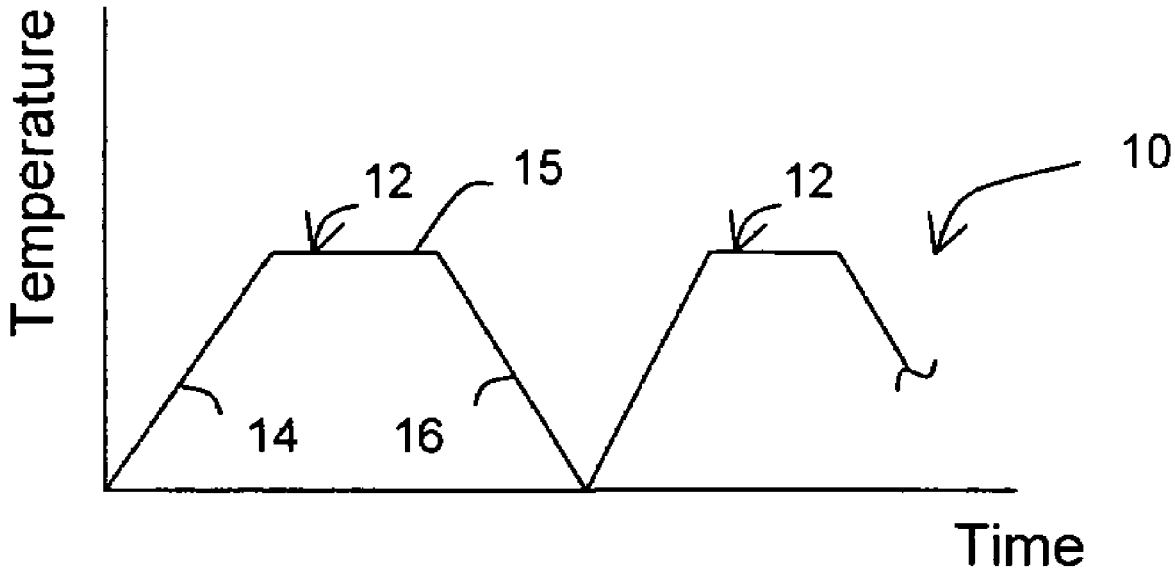
FIG. 1 is a graph of a thermal cycling process for conditioning a CMP pad according to one method of the invention.

FIG. 1 illustrates a graph 10 of temperature as a function of time as the polishing pad is subjected to multiple heating-cooling cycles 12 of the controlled thermal cycling process.

Each cycle 12 may include a heating ramp 14, a plateau section 15, and a cooling ramp 16. The ramps 14 and 16 involve transitioning between a lower and a higher temperature, with the higher temperature being a maximum temperature. The maximum temperature is maintained during the plateau section 15 for a predetermined time period. The thermal cycling may be conducted in an inert atmosphere, such as a nitrogen $N_2$ atmosphere, to exclude oxidation.

In one embodiment, the maximum temperature may be approximately 100° C. during the cycles 12. This thermal cycling may change the pad structure so that unstable crystalline areas are destroyed and, due to a maximum temperature of approximately 100° C. or less, may not affect other pad properties which may be affected with the use of a heat ramp to or greater than 200° C. as undertaken in the prior art.

Figure 2:
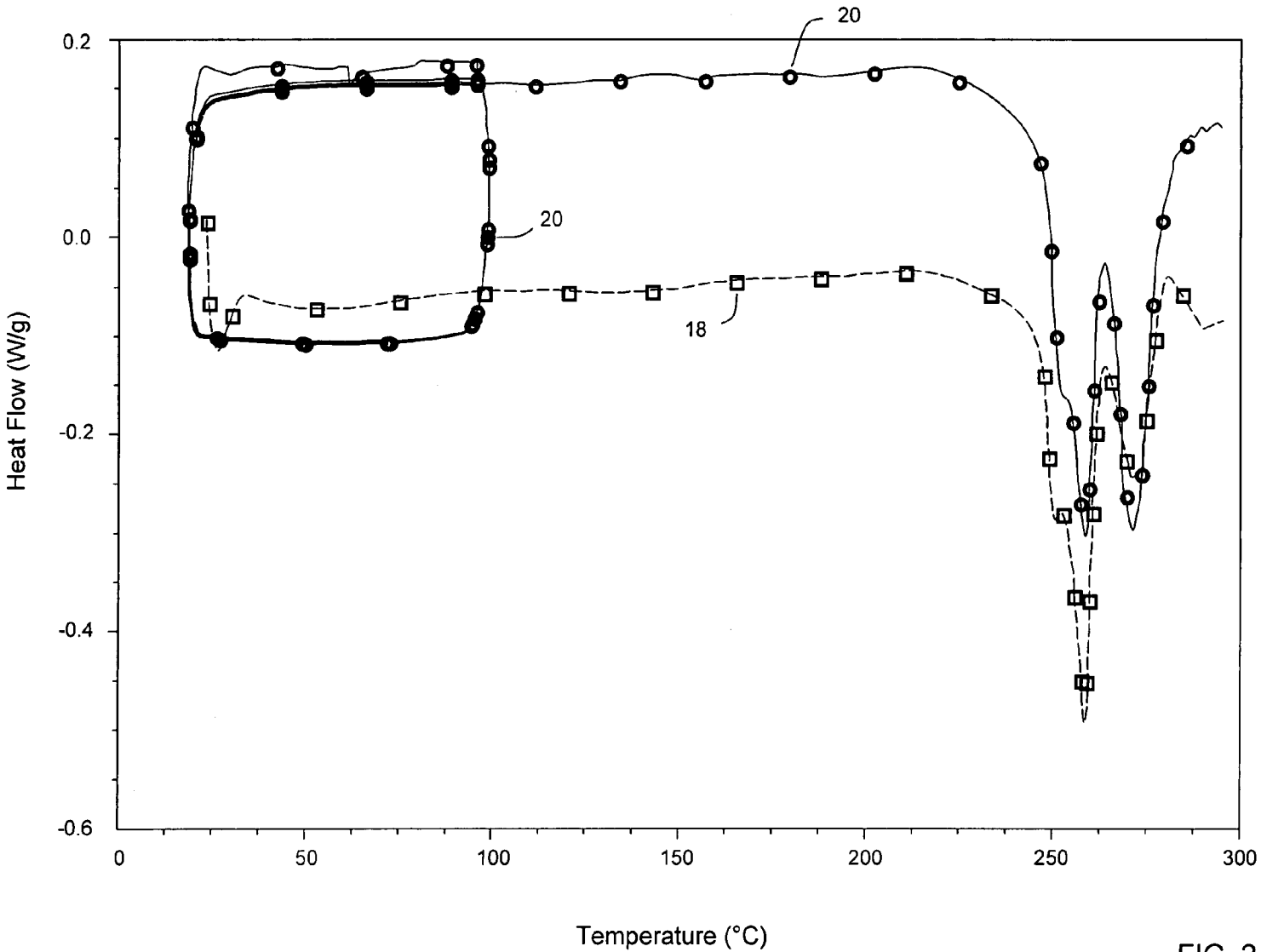
FIG. 2 is a graph of DSC data results for a CMP pad.
Figure 3:
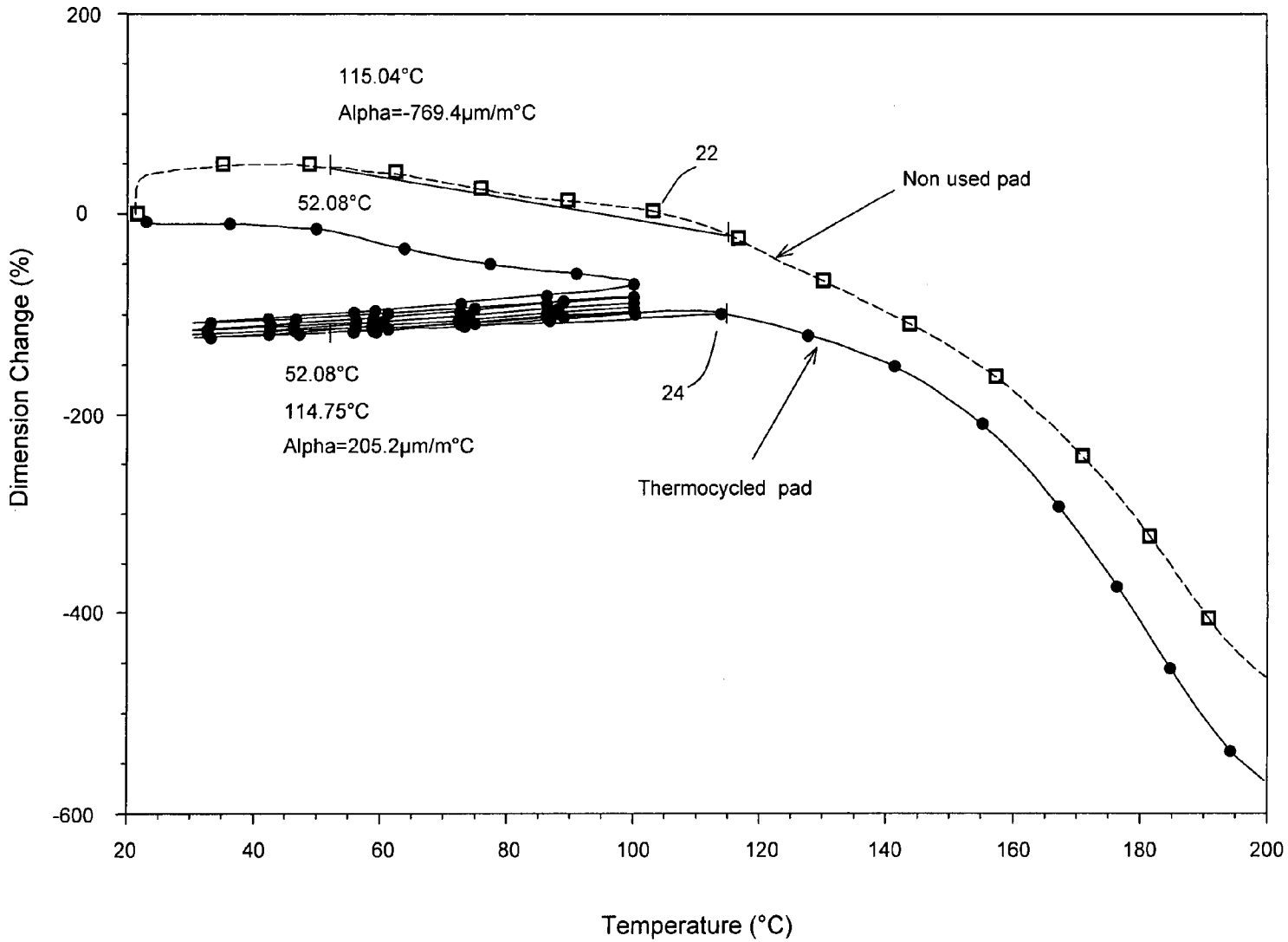
FIG. 3 is a graph of TMA data results for a CMP pad.
Figure 4:
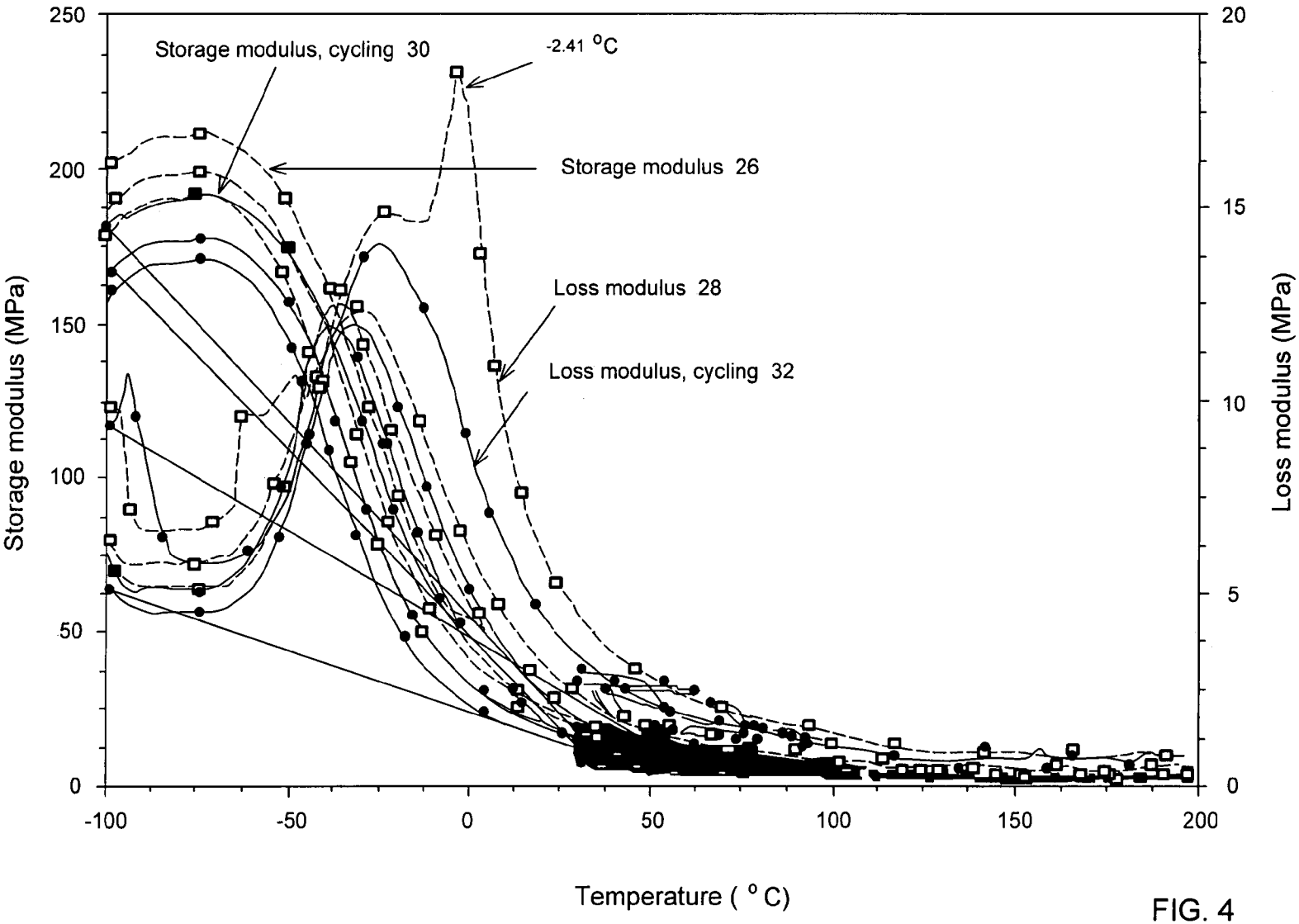
FIG. 4 is a graph of DMA data results for a CMP pad.

Specific examples of conducted thermo-analytical tests of the pad samples with a thermal cycle process having five heating-cooling cycles 12 are provided wherein the test results are compared with and without the thermal cycling process. More specifically, the results from a Differential Scanning Calorimeter (DSC), a Thermal Mechanical Analyzer (TMA), a Dynamic Mechanical Analyzer (DMA) cycling tests are shown in FIGS. 2, 3, and 4, respectively. The results establish that cycling irreversibly changes the pad properties in eliminating the crystalline structures. As such, the desired change of the pad properties may be achieved by the thermal cycling of the pad in the inert atmosphere before the pad is used in a CMP polisher. Appropriate cycle temperature, period, and number of the cycles may be controlled to achieve desired properties of the pre-CMP pads, with some examples being given below. In general, DSC, TMA, and DMA measurements may show a shift of glass transition, a disappearance of exothermic peaks related to the break up of the crystallite phase of polyurethane, and a change in the coefficient of thermal expansion in comparing a new unused pad subject to a heat ramp and a new unused pad subject to thermal cycling, which may be identified as a "thermally cycled pad". A non-reversing heat flow occurs with a non-reversing event, such as the elimination of crystallization or degradation of the pad.

Referring to FIGS. 1 and 2, DSC data in the form of a curve 18 (square points) show a new and non-used pad subjected to a linear temperature heat ramp without thermal recycling. DSC data in the form of a curve 20 (circular points) show a new and non-used pad subjected to a thermal cycling process. In the thermal cycling process, each cycle 12 may have the heating ramp 14 and the cooling ramp 16 which change at a rate (temperature gradient) of 10° C./min, in the range between 30° C. and 100° C., at an isotropic heating for 1 minute at 100° C. during the plateau section 15, in an inert N2 atmosphere. The curve 20 shows that thermo cycling changes in the amounts of exothermic peaks in a temperature range close to decomposition.

Referring to FIGS. 1 and 3, a TMA test involves a thermal analysis technique in which mechanical properties of a pad are measured as a function of temperature. TMA data in the form of a curve 22 show a new and non-used pad subjected to a linear temperature heat ramp, but without thermal cycling. TMA data in the form of a curve 24 show a new and non-used pad subjected to five thermal cycles 12 of a thermal cycling process. Each cycle 12 may have the heating ramp 14 and the cooling ramp 16 which change at a rate (temperature gradient) of 5° C./min, in the range between 30 and 100° C., at an isotropic heating for 1 minute at 100° C. during the plateau section 15, in an inert $N_2$ atmosphere. The graphs show that thermocycling changes the Dimensional Changes in the range from 30° C. to 100° C. from negative −770 um/mC to positive +205 um/mC. Cycles are shown as grayish areas.

Referring to FIGS. 1 and 4, DMA data in the form of a storage modulus curve 26 and a loss modulus curve 28 are shown for a new and non-used pad subjected to a linear temperature heat ramp without thermal cycling. DMA data in the form of a storage modulus curve 30 and a loss modulus curve 32 are shown for a new and non-used pad subjected to five thermal cycles 12 of a thermal cycling process. Each cycle 12 may have the ramps 14 and 16 which change at a rate (temperature gradient) of 5° C./min, in the range between 30° C. and 100° C., at an isotropic heating for 1 minute at 100° C., in an inert $N_2$ atmosphere. The graphs show that thermo cycling changes the storage modulus measured at low temperatures and changes molecular structure of the pad, as indicated by an additional peak of the loss modulus at −2.4° C. with the thermo-cycled pad, which was absent in the spectra of the non-cycled pad. Cycles are shown as grayish areas.

In one embodiment, the thermal cycling process of FIG. 1 may be undertaken in a Q1000 Differential Scanning Calorimeter, manufactured by Texas Instruments. The Q1000 DSC is capable of use over the temperature range −180 to 725° C., and has computer-controlled heating and cooling to implement the heating ramp 14, plateau section 15 and cooling ramp 16 of FIG. 1. However, many different types of apparatus may be used to implement the thermal cycling process of FIG. 1. To show some of the illustrative components of such an apparatus, one possible thermal cycling apparatus is described with respect to FIG. 5. Such common components that may exist in any applicable apparatus include a chamber for containing the pad and a heating member and a cooling member controlled by a computer. Also, the chamber may be enclosed to contain an inert atmosphere.

Figure 5:
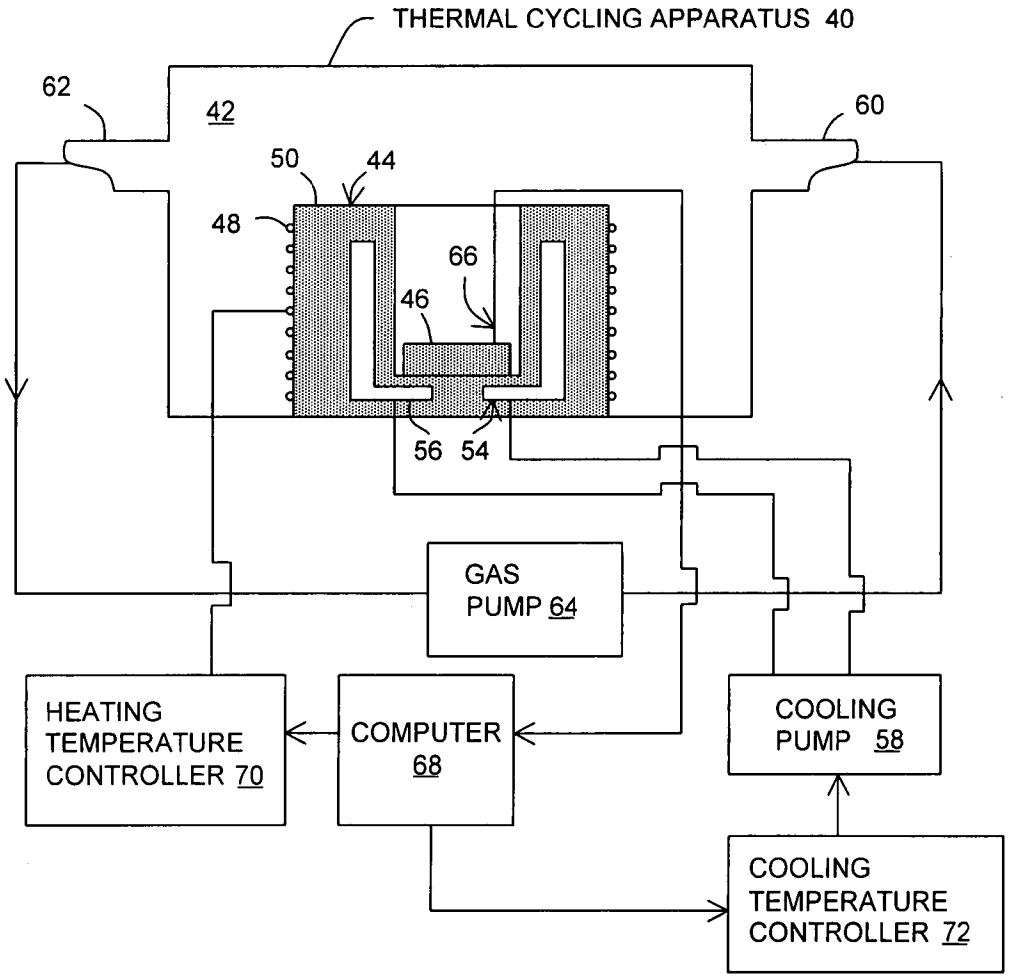
FIG. 5 is a diagram of a thermal cycling apparatus according to one embodiment of the present invention.

Referring to FIGS. 1 and 5, a thermal cycling apparatus 40 is shown in FIG. 5 for implementing the thermal cycling process of FIG. 1. The apparatus 40 may include an enclosed chamber 42 and a heating member 44 positioned in the chamber 42. A polishing pad 46 may be positioned on a hard surface of the heating member 44 or may be raised above it on a platform (not shown). The heating member 44 may provide the heat ramp 14 of FIG. 1 wherein the temperature of the pad 46 is raised from a lower temperature to a higher temperature and maintained at the higher temperature for a predetermined period of time during the plateau section 15 of FIG. 1. In one embodiment, the heating member 44 may be a furnace with a heating coil 48 on the outside of a block 50. A cooling member 54 may be positioned adjacent to the pad 46 to provide the cooling ramp 16 of FIG. 1 wherein the temperature of the pad is lowered from the higher temperature to the lower temperature. In one embodiment, the cooling member 54 may comprise a cooling channel 56 formed in the block 50 for a flowing cooling gas or liquid. The cooling channel 56 may be fluidly coupled to a cooling pump 58. An inlet pipe 60 and an exhaust pipe 62 may be coupled to a gas pump 64 which may be used to fill the chamber 42 with an inert gas, such as nitrogen.

The apparatus 40 further includes a temperature sensor 66 (such as a thermocouple), a computer 68, and a heating temperature controller 70 and a cooling temperature controller 72. Temperature data from the temperature sensor 66 may be recorded and processed in the computer 68. The computer 68 includes a temperature program for implementing the thermal cycling of FIG. 1. The heating temperature controller 70, in response to the computer 68, controls the temperature during the heating ramp 14. The cooling temperature controller 72, in response to the computer 68, controls the temperature during the cooling ramp 16. Although apparatus 40 illustrates examples of heating and cooling members, such members may take many different forms.

In processing the CMP pad during the manufacture of the CMP pad, a desired processing temperature range is determined using a temperature selection process according to another method of the present invention. Processing the wafer within the desired temperature range may avoid degradation of the pad properties, which may result in the release of pad fillers, polymer residuals and the like during a subsequent CMP polishing. Consequently, in this temperature selection process, the pad processing temperature range may be selected to improve CMP pad performance. As previously discussed, one of the stages during manufacture needing elevated temperatures includes a stage wherein the pad is soften to allow for pad patterning. This manufacturing stage is called embossing, or patterning, and it creates an "imprint" of a certain geometry on the pad surface. It is believed that pad embossing may improve the polishing process by providing flow channels for access of the fresh slurry to the polished sites and by removing the excess and used slurry from the polished sites. The temperature used for processing the CMP pad during manufacture is referred to as the "processing temperature". This processing temperature falls within the above-mentioned processing temperature range, which will now be described in more detail.

Temperature selection may be achieved in part by comparing a potential processing temperature with the temperature of decomposition of polymer-based pad (the pad's "decomposition temperature"); the latter is determined using complimentary set of thermo-analytical tools. If the selected processing temperature is too high, equal to or above the decomposition temperature, it may cause pad decomposition, subsequent reduction of pad life, and an increase in the number of the defects. If the selected processing temperature is too low, below or close to a temperature of glass transition (the pad's "glass transition temperature"), it may not allow desirable changes of the pad mechanical properties, such as hardness. In the above-described stage of the pad manufacturing process referred to as "embossing" or "patterning", if temperatures are well below a pad's "softening temperature", then a desired pad groove depth in the pad may not be achieved and this may negatively impact CMP performance. In summary, there is a narrow range of the acceptable processing temperatures between the softening and the decomposition temperatures which define an acceptable processing temperature range.

Polymers, and polymer based pads, frequently may be characterized by a wide range of the glass transition and decomposition temperatures. For a given polymer-based pad, a desired processing temperature may be established using combined thermo-analytical metrologies, such as TMA, DSC, and Thermal Gravimetric Analysis (TGA). In the illustrative tests described below, a soft polishing pad formed of polyurethane was used. As previously mentioned, the desired processing temperatures may prevent pad decomposition during polishing. This may lead to the increase in pad life, and reduction in wafer defects. This also may lead to improved CMP pad performance. Initially, prior to the tests described below, a pressure sensitive adhesive layer was mechanically removed from the pad.

Figure 6:
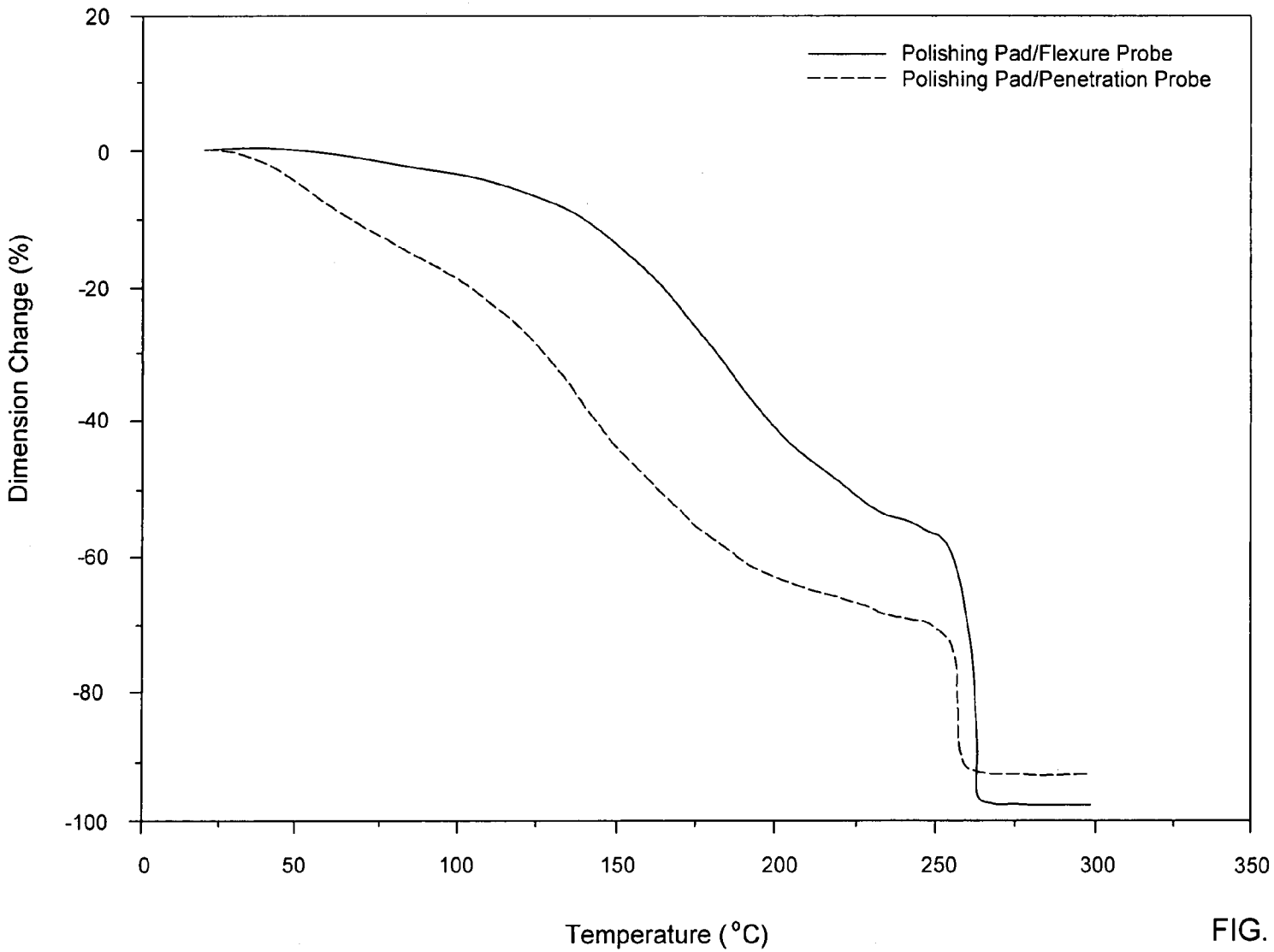
FIG. 6 is a graph of TMA data results for a CMP pad subjected to a heat ramp.

With respect to FIG. 6, TMA measurement results show changes in depth penetration of a probe into the pad material as the material temperature increases. If the pad material does not change its initial hardness, the penetration, shown as the negative percentage Dimension Change on the Y-axis, is equal to zero. In FIG. 6 the pad shows an onset of the softening at approximately 150° C. The results obtained using a knife-edge probe may be desirable for an increase in accuracy. A sharp drop in the Dimension Changes at approximately 255° C. is caused by the complete decomposition of the pad. The midpoint of the Dimension Change, that is close to glass transition temperature, Tg, was observed at approximately 160° C. The temperature at this midpoint may be used as the "softening temperature" for the range of acceptable processing temperatures.

Figure 7:
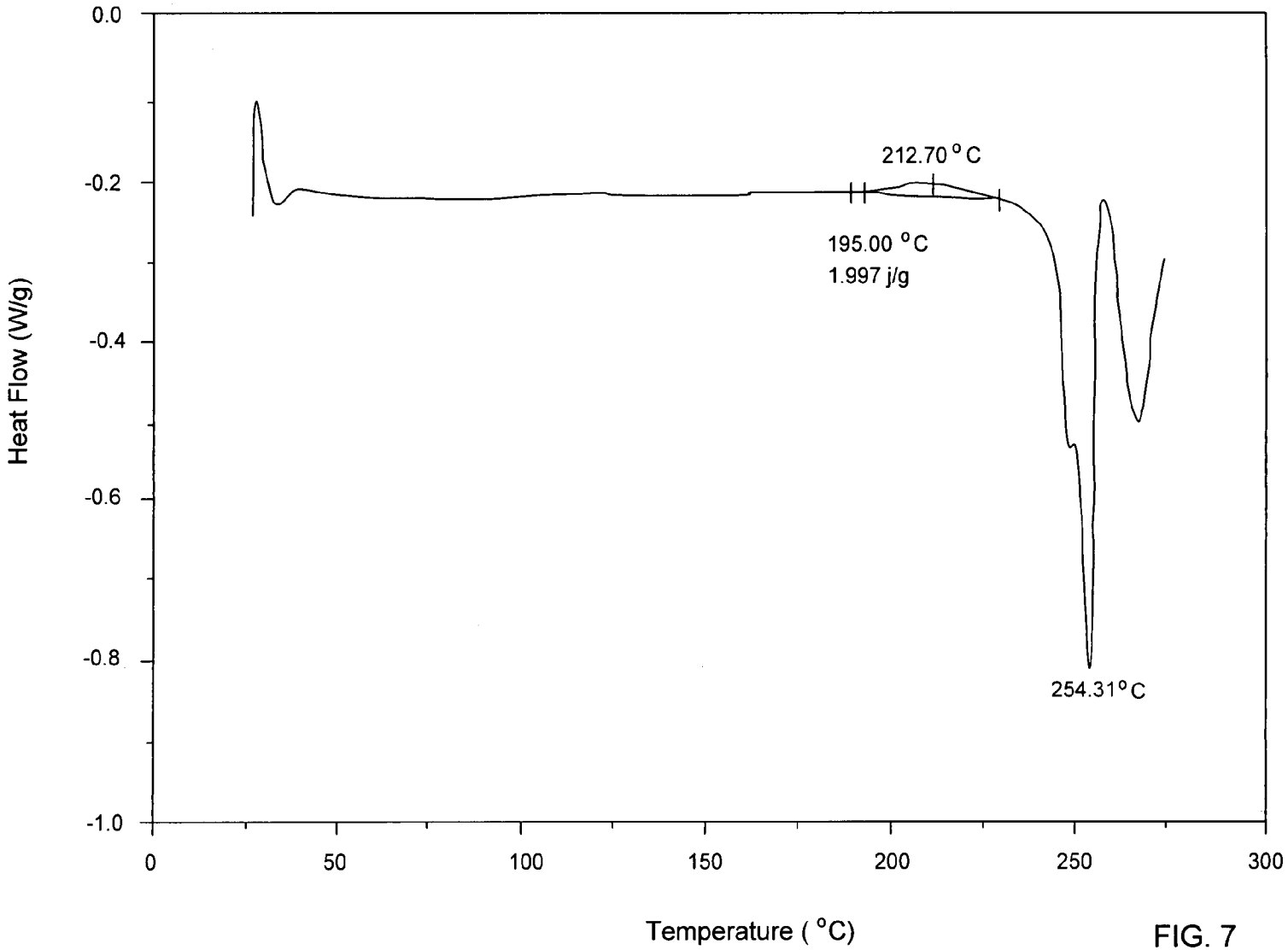
FIG. 7 is a graph of DSC data results for a CMP pad subjected to a heat ramp.

With respect to FIG. 7, modulated DSC measurement results show heat that was released or absorbed during a temperature run. No heat changes were observed up to 194° C. A small exothermic peak, observed at the temperatures above 194° C., can be related to the onset of exothermic process of decomposition. The exothermic peak converts to a huge endothermic peak with the maximum at 254° C. This huge endothermic peak can mask an exothermic peak related to the pad decomposition. Unlike modulated DSC test, a regular DSC test may not be capable of identifying small decomposition peak.

Figure 8:
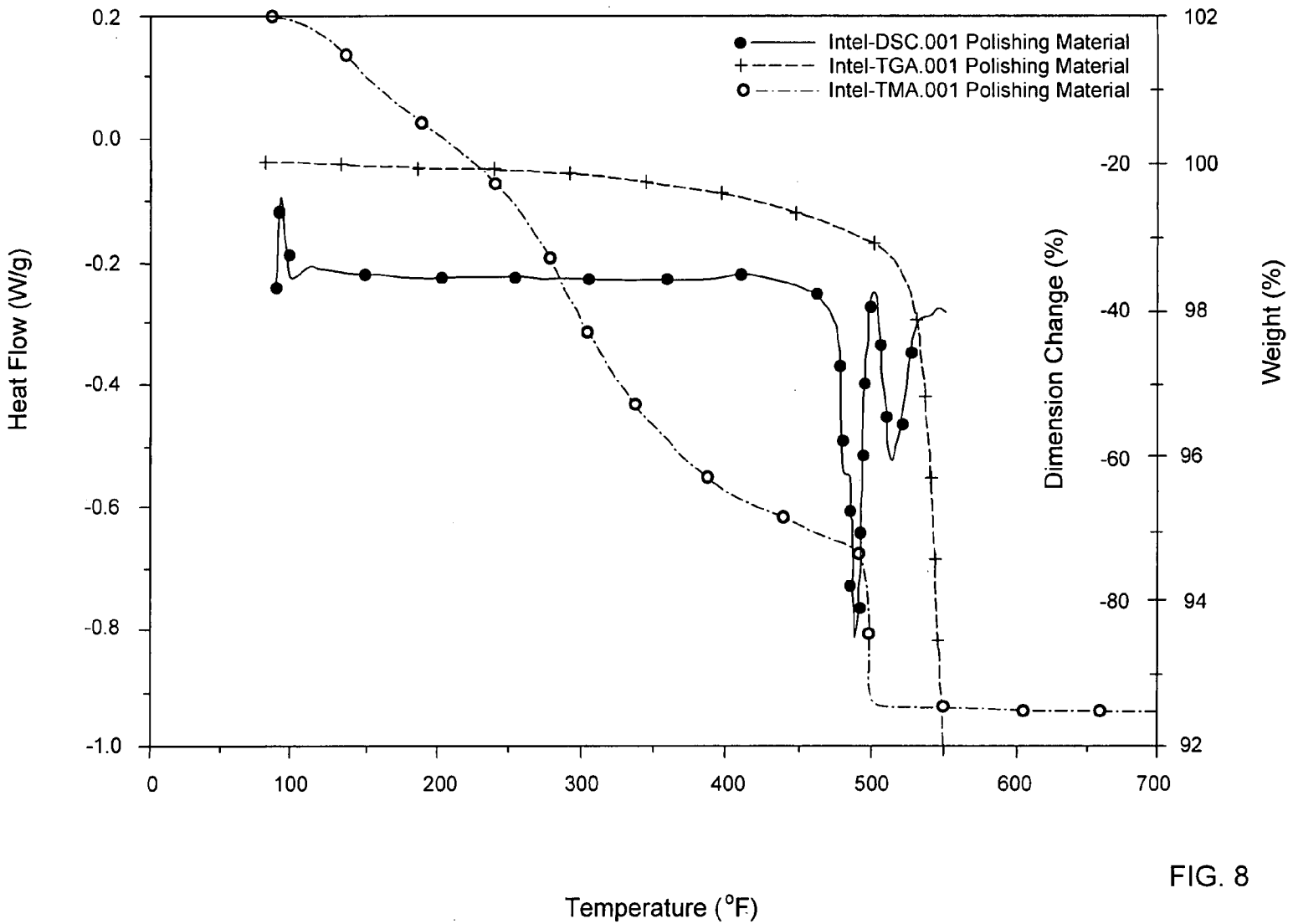
FIG. 8 is a graph of TGA data results for a CMP pad subjected to a heat ramp.

With respect to FIG. 8, TGA measurement results show a weight loss of the material during a heat run. Change in the weight may be associated with polymer decomposition. The onset of decomposition was observed at approximately 225° C. The complete degradation of the material occurred at approximately 275° C. For the purposes of comparison, the graphs in FIGS. 6 and 7 also are included in FIG. 8, along with the graph of the TGA measurements.

In order to provide reliable pad softening (needed, for example, for the pad patterning at elevated temperatures), the pad should be heated at least to or above its softening temperature. Softening temperature, determined as the midpoint of the dimension change in the TMA test, was equal to approximately 160° C. The softening temperature is close to but greater than glass transition temperature, Tg. In order to prevent material decomposition and disintegration of the pad, it should not be heated above the onset of decomposition, which was determined at approximately 195° C. using DSC and TGA tests. As such, for the tested pad, there may be a narrow operating window or range of acceptable processing temperatures, with the window staring at a lower temperature which is equal to or greater than 160° C. (softening temperature) and extends upward to a higher temperature which is less than 195° C. (decomposition temperature).

As shown experimentally for the tested pad, accurate definition of the processing temperature is important, since deviation from this temperature by only ±5° C. may change the pad hardness by 15 to 20%, as confirmed using Thermal Mechanical Analysis. A change of the pad hardness may affect the manufacturer's ability to achieve, in one example, well defined pad patterning, or, in another example, to preserve pad mechanical integrity. In the first example, the highest possible processing temperature should not exceed 195° C., to insure avoiding pad decomposition.

Figure 9:
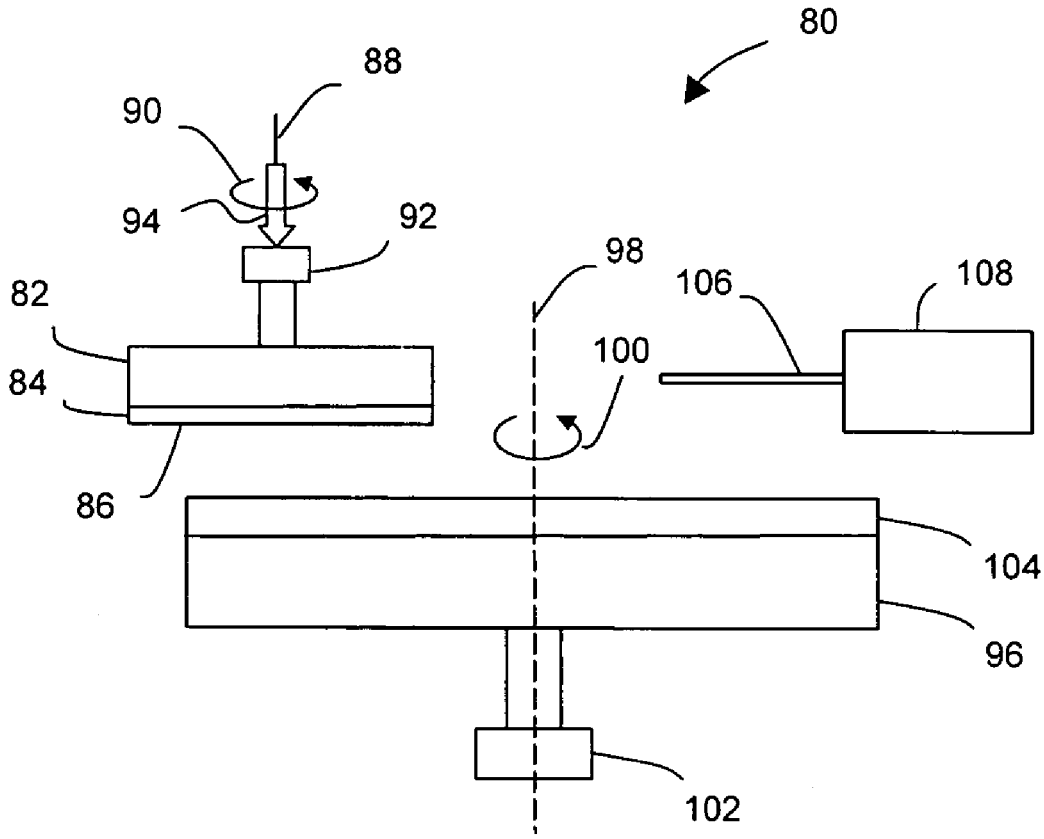
FIG. 9 is a block diagram of a system according to one embodiment of the present invention.

With reference to FIG. 9, there is illustrated a chemical-mechanical polisher 80 in accordance to one embodiment of the present invention. The polisher 80 includes a wafer carrier 82 for holding a semiconductor wafer 84 (e.g., 300 mm diameter) having a surface 86 to be polished. The wafer carrier 82 is mounted for continuous rotation about an axis 88 in a direction indicated by arrow 90 via a drive motor 92 operatively connected to the wafer carrier 82. The wafer carrier 82 is adapted so that a force indicated by arrow 94 is exerted on semiconductor wafer 84. The polisher 80 also includes a polishing platen 96 mounted for continuous rotation about an axis 98 in a direction indicated by an arrow 100 by a drive motor 102 operatively connected to the polishing platen 96. A polishing pad 104 is mounted to polishing platen 96 and may be one of the polishing pad manufactured or conditioned according to the various embodiments of the present invention. A polishing slurry containing an abrasive fluid is dispensed onto polishing pad 104 through a slurry dispensing arm 106 from temperature controlled reservoir 108. The slurry dispensing arm 106 is positioned adjacent to and above the polishing pad 104 and may be aligned radially with center of rotation of the polishing pad 104, which is centered on the axis 98. In other words, the longitudinal axis of the arm 106 may approximately intercept the axis 98. The polishing slurry is dispensed onto polishing pad 104 through the arm 106 from temperature controlled reservoir 108 as the wafer carrier 82 and polishing platen 96 rotate about their respective axes 88 and 98, with the slurry arm 106 remaining fix in location. The force between the polishing platen 96 and the wafer carrier 82 and their relative rotation, in combination with the mechanical abrasion and chemical effects of the slurry, serve to polish wafer surface 86.

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. Therefore, it is manifestly intended that this invention be limited only by the claims and the equivalents thereof.

What is claimed is:

1. A method, comprising:

positioning a chemical-mechanical polishing (CMP) pad when in an unused condition into a thermal cycling apparatus adapted to heat and cool the CMP pad; and using the thermal cycling apparatus for repeatedly cycling the CMP pad between a first temperature and a second temperature higher than the first temperature to eliminate at least one crystalline area in the CMP pad.

2. The method according to claim 1, further comprising:

filling the thermal cycling apparatus with an inert atmosphere prior to the using of the thermal cycling apparatus for repeatedly cycling the CMP pad between the low temperature and the high temperature.

3. The method according to claim 1, wherein the inert atmosphere comprises nitrogen.

4. The method according to claim 1, wherein the second temperature is no greater than 100 degrees centigrade.

5. The method according to claim 1, wherein the second temperature is approximately 100 degrees centigrade and the first temperature is approximately 30 degrees centigrade.

6. The method according to claim 1, wherein the using of the thermal cycling apparatus for repeatedly cycling the CMP pad between the first temperature and the second temperature includes maintaining the CMP pad at or about the second temperature for a predetermined time period.

7. The method according to claim 6, wherein the predetermined time period is approximately one minute.

8. The method according to claim 1, wherein the using of the thermal cycling apparatus for repeatedly cycling the CMP pad between the first temperature and the second temperature includes ramping up from the first temperature to the second temperature and ramping down from the second temperature to the first temperature.

9. The method according to claim 8, wherein the using of the thermal cycling apparatus for repeatedly cycling the CMP pad between the first temperature and the second temperature includes injecting heat into the CMP pad by use of a heating member during the ramping up from the first temperature to the second temperature.

10. The method according to claim 9, wherein the using of the thermal cycling apparatus for repeatedly cycling the CMP pad between the first temperature and the second temperature further includes removing heat from the CMP pad by use of a cooling member during the ramping down from the second temperature to the first temperature.

11. The method according to claim 1, wherein the using of the thermal cycling apparatus for repeatedly cycling the CMP pad between the first temperature and the second temperature includes controlling a ramping up from the first temperature to the second temperature with a computer, and controlling a ramping down from the second temperature to the first temperature with the computer.

12. The method according to claim 1, further comprising:

mounting the CMP pad in a chemical-mechanical polisher after the using of the thermal cycling apparatus for repeatedly cycling the CMP pad; and polishing a wafer mounted in the chemical-mechanical polisher with the CMP pad.

13. The method according to claim 1, wherein the using of the thermal cycling apparatus for repeatedly cycling the CMP pad between the first temperature and the second temperature includes ramping up from the first temperature to the second temperature at a first rate selected from a range of 10 degrees centigrade per minute to 20 degrees centigrade per minute, and ramping down from the second temperature to the first temperature at a second rate selected from the range of 10 degrees centigrade per minute to 20 degrees centigrade per minute.

14. The method according to claim 1, wherein the using of the thermal cycling apparatus for repeatedly cycling the CMP pad between the first temperature and the second temperature includes repeatedly cycling the CMP pad between the first and the second temperatures approximately 5 times and between the second and the first temperature approximately 5 times.

15. A system, comprising:

a thermal cycling apparatus including a chamber adapted to receive a chemical-mechanical polishing (CMP) pad in a new condition; a heating and a cooling member disposed within the chamber and adapted to heat and cool the CMP pad respectively; and a temperature sensor disposed in the chamber and adapted to generate a temperature signal in response to a temperature of the CMP pad; and a computer, coupled to the temperature sensor, the heating member, and the cooling member and adapted to control repeated cycling of the CMP pad between a first temperature and a second temperature, to generate a cycled pad substantially without a crystalline area, the second temperature being higher than the first temperature.

16. The system according to claim 15, wherein the system further comprises:

a chemical-mechanical polisher having mounted therein the cycled pad after the cycled pad is processed by the thermal cycling apparatus.

17. The system according to claim 15, wherein the chamber is adapted to include an inert atmosphere.

18. The system according to claim 15, wherein the second temperature is approximately 100 degrees centigrade.

19. The system according to claim 15, wherein the computer is adapted to maintain the second temperature for a predetermined time period.

20. The system according to claim 15, wherein the computer is adapted to control the heating member to at least contribute in ramping up the CMP pad from the first temperature to the second temperature.

21. The system according to claim 20, wherein the computer is adapted to control the cooling member to at least contribute in ramping down the CMP pad from the high temperature to the low temperature.

22. The system according to claim 15, wherein the computer is adapted to selectively control the heating and cooling members to contribute in repeated ramping up from the first temperature to the second temperature at a first rate selected from a range of 10 degrees centigrade per minute to 20 degrees centigrade per minute, and repeated ramping down from the second temperature to the first temperature at a second rate selected from the range of 10 degrees centigrade per minute to 20 degrees centigrade per minute.

23. A method of selecting a processing temperature for a chemical-mechanical polishing (CMP) pad, comprising:

selecting a lower temperature to be approximately greater than or equal to a softening temperature of the CMP pad;

selecting a higher temperature to be less than a decomposition temperature of the CMP pad; and selecting the processing temperature from a processing temperature range defined by the lower and higher temperatures.

24. The method according to claim 23, wherein the CMP pad is formed of polyurethane; and the decomposition temperature is approximately equal to 195 degree centigrade.

25. The method according to claim 24, wherein the softening temperature is approximately equal to 160 degrees centigrade.

26. The method according to claim 23, wherein the softening temperature is greater or equal to a glass transition temperature of the CMP pad.

27. The method according to claim 23, further comprising:

determining the softening temperature to be a temperature at a midpoint of a dimension change measurement provided by a thermal mechanical analyzer.

28. The method according to claim 27, wherein the determining of the softening temperature to be the temperature at the midpoint of the dimension change measurement includes ramping up a temperature of the CMP pad during the dimension change measurement.

29. The method according to claim 23, further comprising:

using a set of thermo-analytical tools to determine the decomposition temperature of the CMP pad, the thermo-analytical tools including a differential scanning calorimeter and a thermal gravimetric analyzer.

30. The method according to claim 23, further comprising:

polishing a wafer in a chemical-mechanical polisher with the CMP pad.

* * * * *

UNITED STATES PATENT AND TRADEMARK OFFICE

CERTIFICATE OF CORRECTION

PATENT NO. : 7,048,610 B1
APPLICATION NO. : 11/044125
DATED : May 23, 2006
INVENTOR(S) : Tregub et al.

It is certified that error appears in the above-identified patent and that said Letters Patent is hereby corrected as shown below:

Column 4
Line 44, "...heat ramp 14..." should read --...heating ramp 14...--.

Column 10
Lines 3-4, "...195 degree centigrade." should read --...195 degrees centigrade.--.

Signed and Sealed this

Twenty-seventh Day of May, 2008

JON W. DUDAS
*Director of the United States Patent and Trademark Office*